US008783593B2

(12) United States Patent
Peterson et al.

(10) Patent No.: US 8,783,593 B2
(45) Date of Patent: Jul. 22, 2014

(54) MATERIAL REDUCTION MACHINE

(75) Inventors: Arnold Neil Peterson, Eugene, OR (US); Bradley Simon Harness, Springfield, OR (US)

(73) Assignee: Astec Industries, Inc., Chattanooga, TN (US)

( * ) Notice: Subject to any disclaimer, the term of this patent is extended or adjusted under 35 U.S.C. 154(b) by 238 days.

(21) Appl. No.: 13/491,344

(22) Filed: Jun. 7, 2012

(65) Prior Publication Data

US 2013/0008987 A1 Jan. 10, 2013

Related U.S. Application Data

(60) Provisional application No. 61/571,873, filed on Jul. 7, 2011.

(51) Int. Cl.
*B02C 17/02* (2006.01)
*B02C 13/00* (2006.01)
*B02C 23/00* (2006.01)

(52) U.S. Cl.
USPC ..... 241/73; 241/88.4; 241/242; 241/285.1

(58) Field of Classification Search
USPC ..... 241/88.4, 73, 242, 243, 285.1–290
See application file for complete search history.

(56) References Cited

U.S. PATENT DOCUMENTS 2,420,670 A * 5/1947 Lanter ..... 241/88.4
4,383,652 A * 5/1983 Osborne et al. ..... 241/88.4
5,005,620 A 4/1991 Morey
5,362,004 A 11/1994 Bateman
5,381,971 A * 1/1995 Rehmer ..... 241/55
5,390,862 A 2/1995 Eglin
5,526,988 A * 6/1996 Rine ..... 241/23
5,692,548 A 12/1997 Bouwers et al.
5,692,549 A 12/1997 Eggers
5,819,825 A 10/1998 Lyman et al.
6,016,855 A 1/2000 Morey
6,032,707 A 3/2000 Morey
8,336,797 B2 * 12/2012 Wakamatsu et al. ..... 241/189.1
2002/0050538 A1 * 5/2002 Fabio ..... 241/88.4

OTHER PUBLICATIONS

International Search Report and Written Opinion of International Searching Authority for Corresponding PCT Application.

* cited by examiner

*Primary Examiner* — Faye Francis
(74) *Attorney, Agent, or Firm* — Chambliss, Bahner & Stophel, P.C.

(57) ABSTRACT

A material reduction machine includes a frame, a drum housing mounted to the frame, and a drum that is mounted for rotation within the drum housing. The drum includes a circumferential wall and a knife that is mounted on the drum. The machine includes a plurality of interchangeable belly bands, each of which is adapted to be removably attached to the frame so as to form a portion of the drum housing and to provide an inner surface that forms a belly band arc portion that is concentric with and of a larger diameter than the circumferential wall of the drum. A first interchangeable bellyband has a smooth inner surface, and a second interchangeable belly band has a plurality of flow interrupters spaced along its inner surface.

20 Claims, 7 Drawing Sheets

MATERIAL REDUCTION MACHINE

CROSS-REFERENCE TO RELATED APPLICATION

This application claims the benefit of U.S. Provisional Patent Application No. 61/571,873, which was filed on Jul. 7, 2011.

FIELD OF THE INVENTION

The present invention relates generally to material reduction machines such as wood chippers, and more particularly, to a material reduction-machine having-a cylindrical drum with one or more cutting knives spaced about its circumferential wall.

BACKGROUND OF THE INVENTION

Material reduction machines are used to reduce larger pieces of material into smaller pieces by cutting, chopping, shredding or breaking. Generally, a material-reduction machine will have an enclosure for a reducing mechanism, such as a rotating disc or drum equipped with blades, knives or hammers. The enclosure will typically have a feed inlet through which the larger materials to be reduced are introduced, and a discharge outlet through which the smaller materials are discharged after reduction. One type of material reduction machine is a wood chipper that is used to reduce trees and, their limbs and branches to wood chips. The use of wood chippers avoids the environmental and other problems associated with burning trees and brush or with depositing them in a landfill. Furthermore, by reducing wood to chips of a useful size, a wood chipper may be employed to produce a valuable chip product. Wood chips can be used as mulch or fuel. They can also be used as raw material for creating a pelletized fuel product or as raw material in a chemical pulp process. Wood chips that are intended for use as fuel or in a pelletizing process may first need to be dried. It is desirable that such chips have a uniform chip thickness and a high surface area to volume ratio. It is also desirable that chips which are intended for use in a pulp process be of a uniform size. Ideal pulp chips fall into a narrow thickness range so that they can cook and delignify uniformly. Long and narrow chips and very small chips are undesirable because they can plug the pulp process screens and overcook, thereby damaging the wood fibers and reducing the strength of the pulp.

Most wood chippers are either disc chippers or drum chippers. Disc chippers include knives mounted on a rotating disc that cut across the grain of the wood stem generally perpendicular to the direction of the grain. Disc chippers create chips of a generally uniform size. However, such chippers do not have the production capacity of drum chippers. Drum chippers include knives mounted around the circumferential wall of a cylindrical drum that cut across the wood feed stock in a path that varies with respect to the orientation of the grain of the feed stock to the drum. In the part of the wood feed stock where the knives encounter the wood near the three o'clock or the nine o'clock position of the drum, depending on the side of entry of the feed stock, the knives pass across the wood in a direction that is perpendicular to the direction of the grain. In the part of the feed stock where the knives encounter the wood nearer the six o'clock position of the drum, the knives pass across the wood in a path that is more parallel to the direction of the grain. Because the cutting path angle relative to the direction of the grain varies in this manner, the chips break from the feed stock differently, with the chips cut by the drum nearer its six o'clock position tending to be longer and more irregular in size.

The cutting drum of a drum chipper is rotated in a housing having only a slightly larger diameter than the arc cut by the leading edges of the knives. Because such drum chippers are known to jam with chips and stall, some such chippers are provided with blowers or augers to release the chips from the knives and propel them into a discharge chute. It is also known to provide a drum chipper having a pocket in the drum associated with each knife. U.S. Pat. No. 5,005,620 describes a drum chipper in which the peripheral wall of the drum defines a spaced pocket behind each knife. Each knife in this assembly is generally centered within its pocket so that chips may enter the pocket on the leading edge side of the knife and exit the pocket on the trailing edge side of the knife. As the drum rotates, wood chips cut by each knife enter the pocket on the leading edge side and pass behind the knife. The wood chips in each pocket remain in the pocket until the drum rotates to align the trailing edge side of the knife with the discharge chute, where the chips are expelled into the chute under the influence of centrifugal force. Despite these improvements in drum chipper technology, it is still the case that drum chippers generally produce a significant fraction of chips that are long and irregular in size. Such chip may not be useful as raw material for pelletizing and chemical pulping processes.

It would be desirable if a material reduction machine such as a drum chipper could be provided that would allow for more control of the size and shape of chips produced. It would also be desirable if such a drum chipper could be adapted to produce wood chips that are suitable for various uses.

ADVANTAGES OF THE INVENTION

Among the advantages of a preferred embodiment of the invention is that it provides a drum-type material reduction machine that can be easily adapted to produce wood chips that are suitable for use in a chemical pulp process, or to produce wood chips that are suitable for other purposes. Other advantages and features of this invention will become apparent from an examination of the drawings and the ensuing description.

Notes on Construction

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use, of such terms in describing a physical or functional characteristic of the invention is not intended to limit such characteristic to the absolute value which the term modifies, but rather to provide an approximation of the value of such physical or functional characteristic. The use of any and all examples or exemplary language (e.g., "such as") herein is intended merely to better illuminate the invention and not to place a limitation on the scope of the invention. Nothing in the specification should be construed as indicating any element as essential to the practice of the invention unless so stated with specificity.

Various terms are specifically defined herein. These terms are to be given their broadest possible construction consistent with such definitions, as follows:

The term "material reduction machine" refers to a machine that is adapted to cut, chop, shred, break or otherwise reduce material into smaller pieces.

The terms "upper", "top" and similar terms, when used in reference to a relative position or direction on or with respect to a material reduction machine, or a component or portion of such a machine, refer to a relative position or direction that is farther away from the ground on which the material reduction machine is placed for operation.

The terms "lower", "bottom" and similar terms, when used in reference to a relative position or direction on or with respect to a material reduction machine, or a component or portion of such a machine, refer to a relative position or direction that is nearer the ground on which the material reduction machine is placed for operation.

The term "discharge direction" means the direction that reduced material is conveyed from the discharge chute of the material reduction machine, along the centerline, of the machine.

The term "front end" and similar terms refer to the end of a material reduction machine, or a component or portion of such a machine, which is farthest from the discharge outlet of the machine.

The terms "forward", "in front of", "upstream" and similar terms, as used herein to describe a relative position or direction on or in connection with a material reduction machine or a component of such a machine, refer to a relative position or direction towards the front end of the machine.

The terms "back end", "rear end", "downstream" and similar terms refer to the end of a material reduction machine, or a component or portion of such a machine, which is nearest the discharge outlet of the machine.

The terms "rearward", "behind" and similar terms, as used herein to describe a relative position or direction on or in connection with a material, reduction machine or a component of such a machine, refer to a relative position or direction towards the rear end of the machine.

The term "leading edge", as used herein in connection with a knife that is mounted, on the circumferential wall of a drum, or as used herein in connection with a flow interrupter that is spaced along the inner surface of a belly band, refers to the edge of the knife or flow interrupter that first contacts material within the drum housing.

The term "flow diverter" refers to a plate, bar, rod or other shaped component having a length that is greater than its width.

The term "width", as used herein to describe a material reduction machine, or a component of such a machine, refers to the dimension of the machine or component in a direction that is perpendicular to the discharge direction.

SUMMARY OF THE INVENTION

The invention comprises a material reduction machine that includes a frame, a drum housing mounted to the frame, and a drum that is mounted for rotation within the housing. The drum comprises a circumferential wall and a knife that is mounted on the drum with respect to the circumferential wall so that as the drum rotates, the leading edge of the knife cuts an arc that is concentric with and of a larger diameter than the circumferential wall of the drum. The material reduction machine also includes means for rotating the drum within the housing, a feed chute for directing material to be reduced into the drum housing and a discharge chute for directing reduced material away from the drum housing. The machine also includes a plurality of interchangeable belly bands. Each belly band is adapted to be removably attached to the frame so as to form a portion of the drum housing and to provide an inner surface that forms a belly band arc portion that is concentric with and of a larger diameter than the circumferential wall of the drum, so that said belly band arc portion is adjacent to a portion of the arc cut by the leading edge of the knife. The plurality of interchangeable belly bands comprises a first interchangeable belly band having a smooth inner surface, and a second interchangeable belly band having a plurality of flow interrupters spaced along its inner surface.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described herein.

BRIEF DESCRIPTION OF THE DRAWINGS

The presently preferred embodiments of the invention are illustrated in the accompanying drawings, in which:

FIG. 3 illustrates a first cutting stage.

DESCRIPTION OF THE PREFERRED EMBODIMENTS OF THE INVENTION

Figure 1:
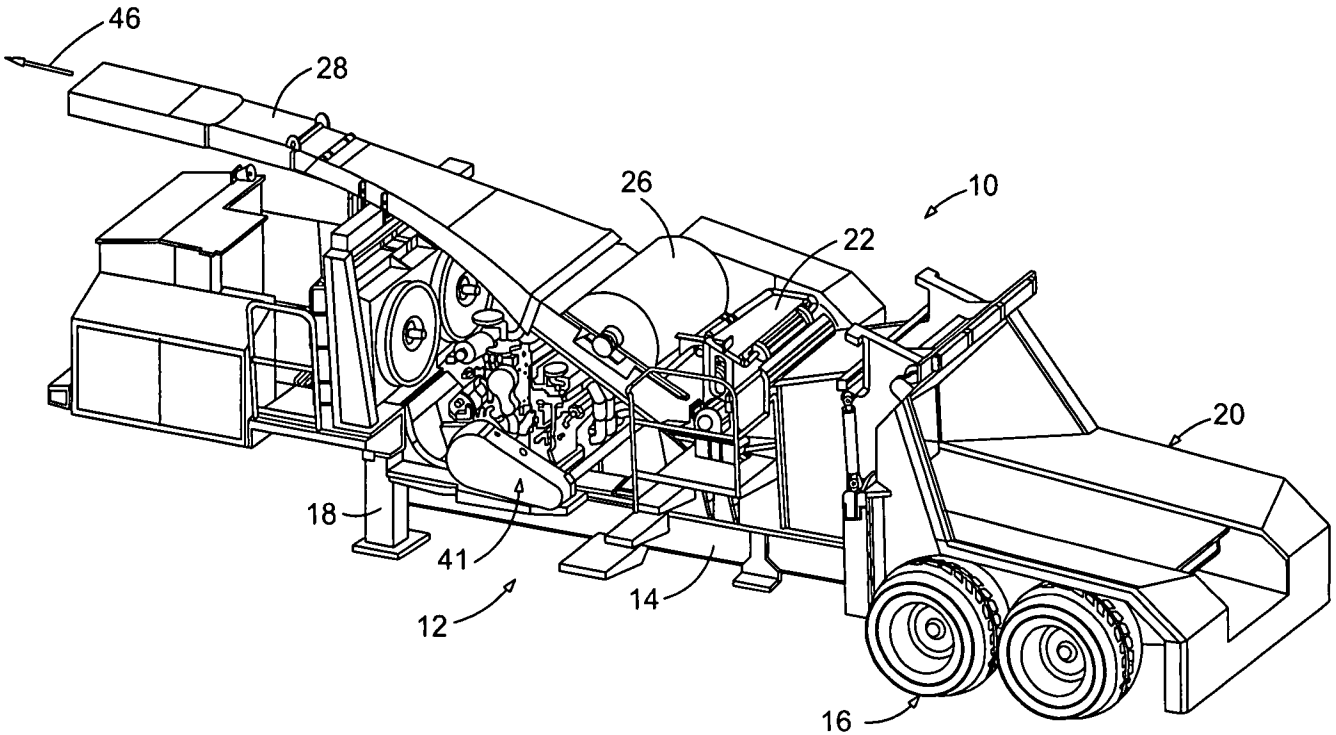
FIG. 1 is a perspective view of a material reduction machine that includes the invention.

The invention comprises a material reduction machine such as a drum-type wood chipper. As shown in FIG. 1, preferred wood chipper 10 includes trailer 12 that is adapted to be pulled by a tractor or other vehicle. Trailer 12 includes frame 14 that is supported by wheels 16 and a pair of adjustable support legs, one of which, support leg 18, is shown in FIG. 1. Supported on frame 14 are feed chute 20, drum housing 22, intermediate housing 24 (best shown in FIGS. 2-4), accelerator wheel housing 26 and discharge chute 28. Intermediate housing 24 is located downstream of drum housing 22, and accelerator wheel housing 26 is located downstream of intermediate housing 24.

Figure 2:
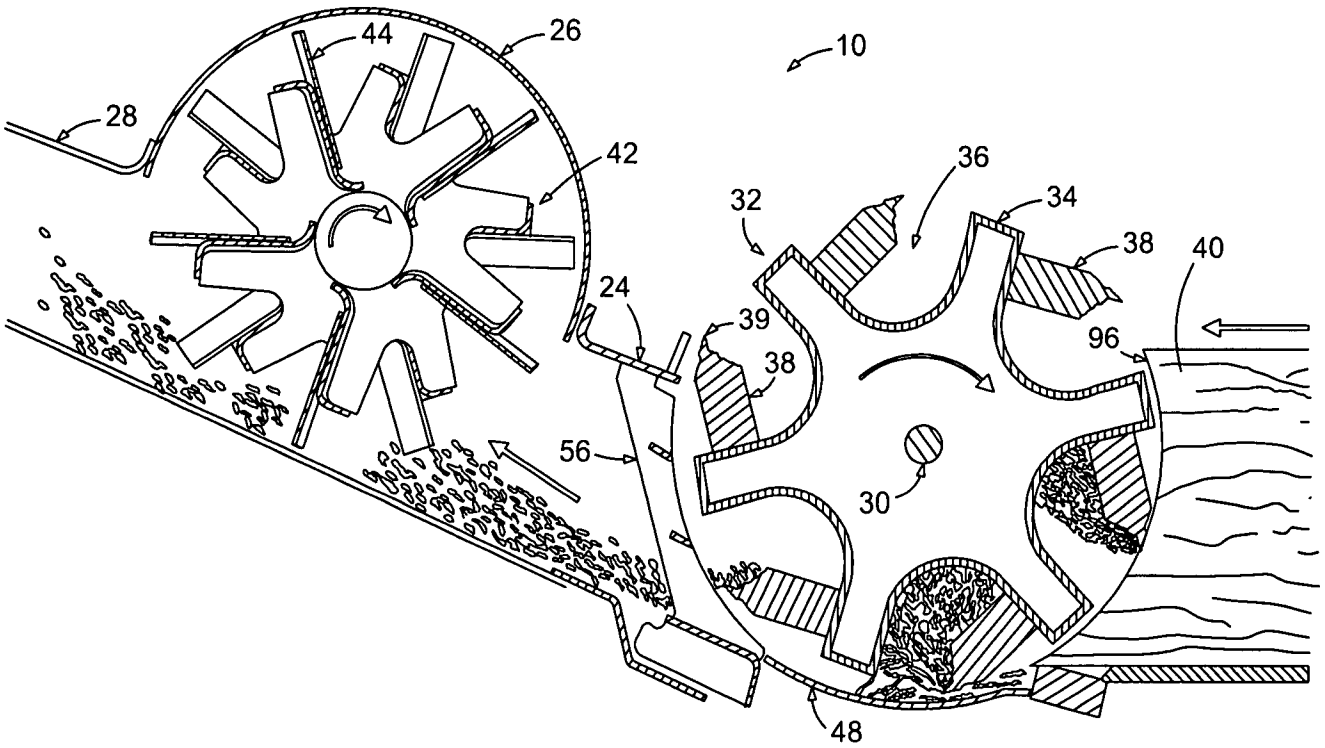
FIG. 2 is a schematic sectional view of a portion of the drum and adjacent accelerator wheel for the embodiment of the material reduction machine that is illustrated in FIG. 1, wherein the drum housing is equipped with a first interchangeable belly band that is adapted to provide a smooth inner surface.
Figure 3:
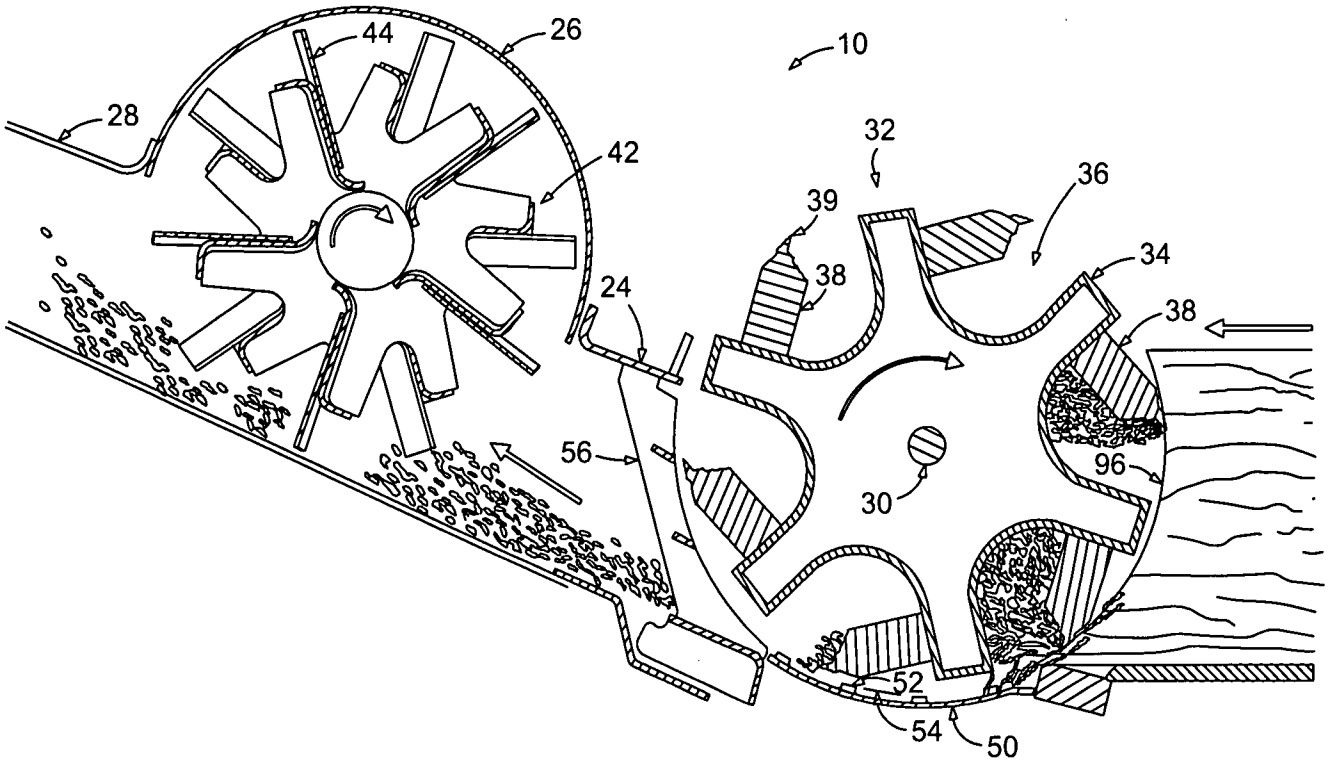
FIG. 3 is a schematic sectional view of a portion of the drum and adjacent accelerator wheel for the embodiment of the material reduction machine illustrated in FIGS. 1 and 2, wherein the drum housing is equipped with a second interchangeable belly band having a plurality of flow interrupters on the inner surface.
Figure 4:
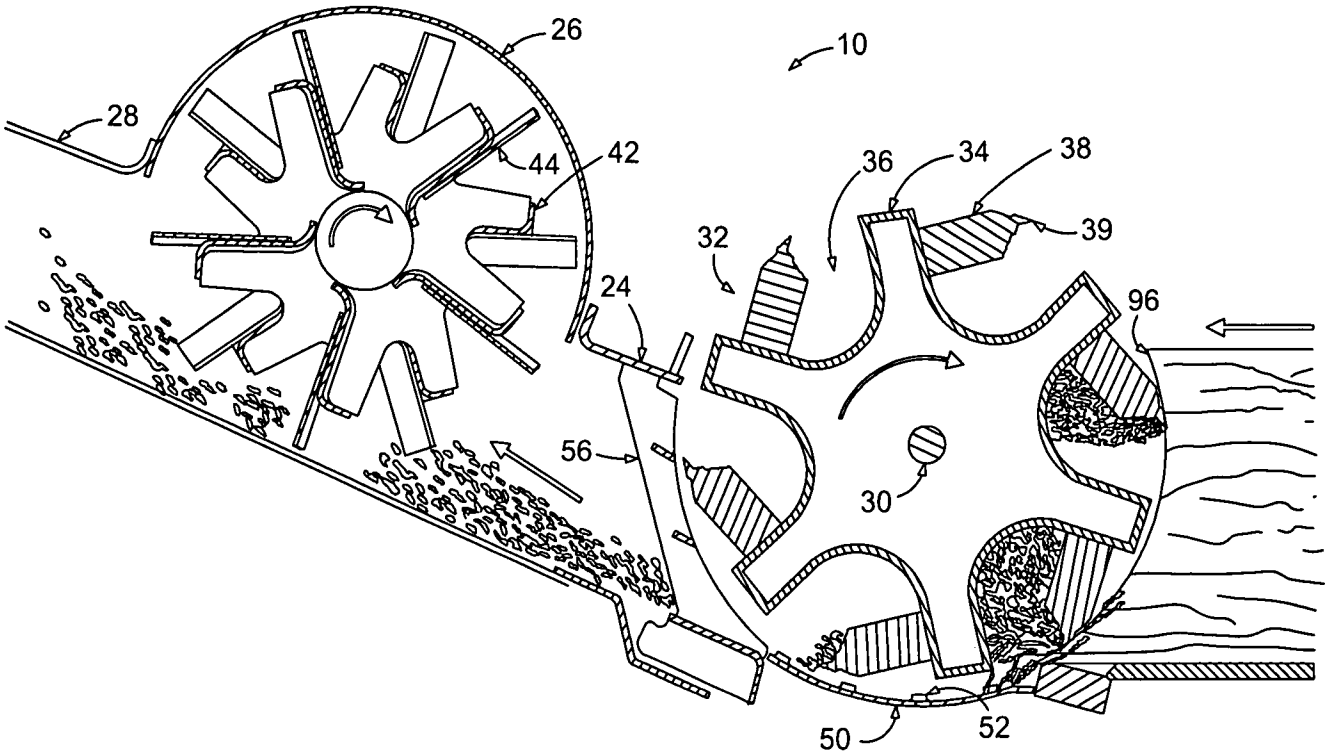
FIG. 4 is a schematic sectional view of the portion of the drum and adjacent accelerator wheel that is illustrated in FIG. 3, showing a second cutting stage.

Mounted for rotation on shaft 30 (in the clockwise direction, as shown in FIGS. 2-4) is drum 32 which includes circumferential wall 34 defining its outer periphery. A plurality of pockets 36 are spaced around the drum and formed in the circumferential wall, and a plurality of conventional knives 38, each of which has a leading edge, 39 are provided. A knife 38 is mounted on each of the pockets so that as drum 32 rotates, the leading edges 39 of the plurality of knives 38 cut an arc that is concentric with and of a larger diameter, than the circumferential wall of the drum, as can be seen by viewing the right side of FIG. 2 where a leading edge of one of the knives cuts into the wood of feed stock 40.

A driver, such as engine 41, is also mounted on the frame and adapted to provide a rotational force to drum 32 within the drum housing by means of one or more drive belts or other conventional drive transfer mechanisms (not shown). Engine 41 is also adapted, to provide a rotational force to accelerator wheel 42, which is provided with a plurality of blades 44, by means of one or more drive belts or other conventional drive transfer mechanisms (not shown). As shown in FIGS. 2-4, the accelerator wheel rotates in the same direction as drum 32 to increase the momentum of reduced material from drum 32. Thus, material to be reduced by material reduction machine 10 is directed into the drum housing from feed chute 20 and the reduced material is discharged through discharge chute 28 in discharge direction 46.

Machine 10 is provided with a plurality of interchangeable belly bands, each of which is adapted to be removably attached to the frame so as to form a portion of the drum housing and to provide an inner surface that forms a belly band arc portion that is concentric with and of a larger diameter than the circumferential wall of the drum. These interchangeable belly bands include first interchangeable belly band 48 having a smooth inner surface (shown in FIG. 2) and second interchangeable belly band 50 having a plurality of flow interrupters spaced along its inner surface, such as flow interrupters 52 shown in FIGS. 3 and 4. As shown in FIGS. 2-4, the belly band arc portion formed by each belly band is adjacent to a portion of the arc cut by the leading edges of the knives.

Preferably, each of flow interrupters 52 comprises abrasion-resistant material in the form of a bar having a sharp leading edge that is mounted on the inner surface of the second interchangeable belly band 50 and extends across the width of drum housing 22. As shown in FIG. 3, the leading edges of flow interrupters 52 define an arc 54 that is concentric with and of a different diameter than the belly band arc portion. In alternative embodiments of the invention, the flow interrupters may comprise discrete elements arranged in a matrix, or they may be rounded, or they may comprise minimal projections from, or depressions in, the inside surface of the belly band. The flow interrupters are adapted to reduce the size of the longer, more irregular chips cut from the lower portion of feed stock 40 (as shown in FIGS. 2-4), and the dimensions, number and spacing of the flow interrupters are selected in order to maximize the production of the desired sized chip.

Figure 5:
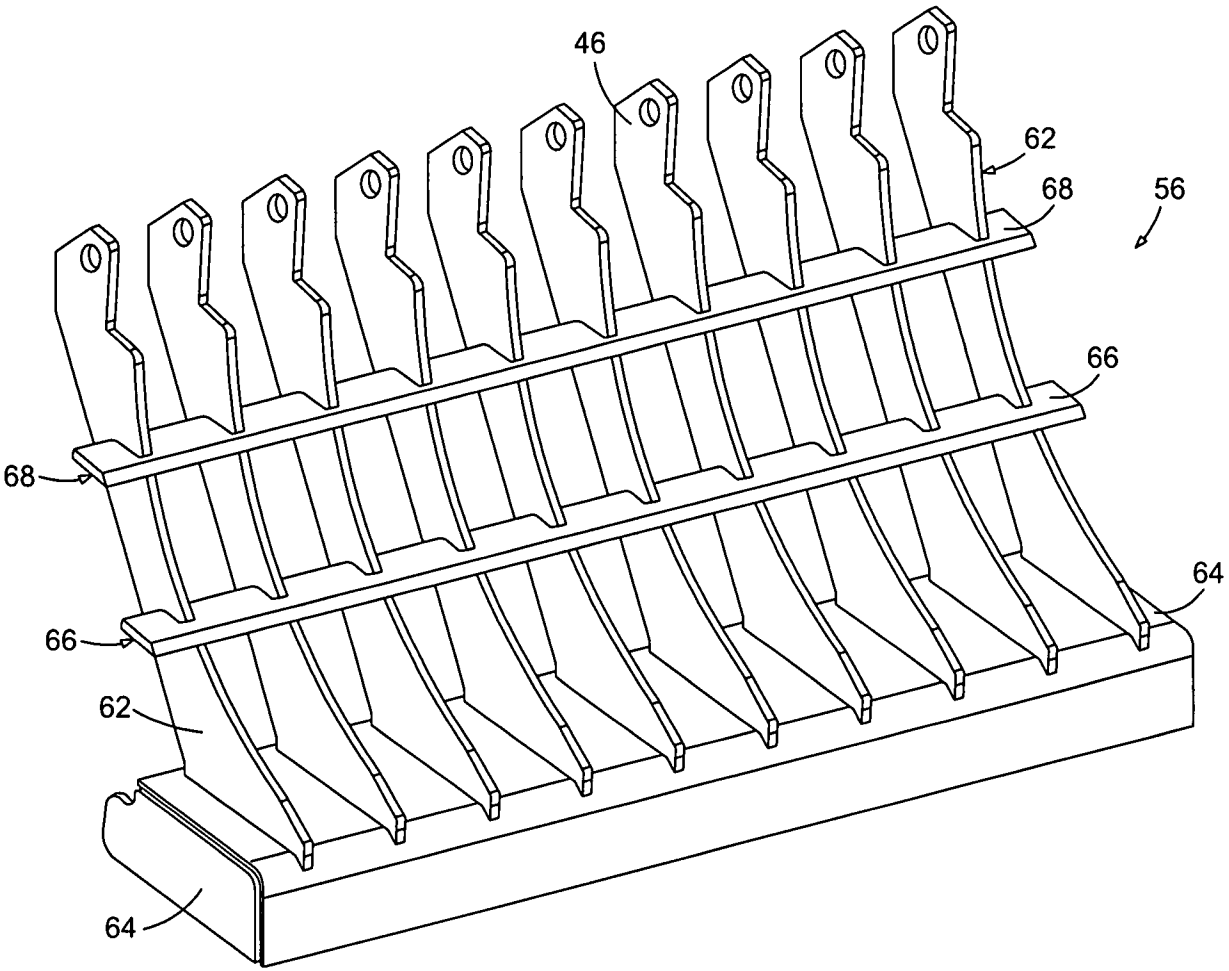
FIG. 5 is a perspective view of a first embodiment of a gauging assembly that comprises a part of the invention.
Figure 6:
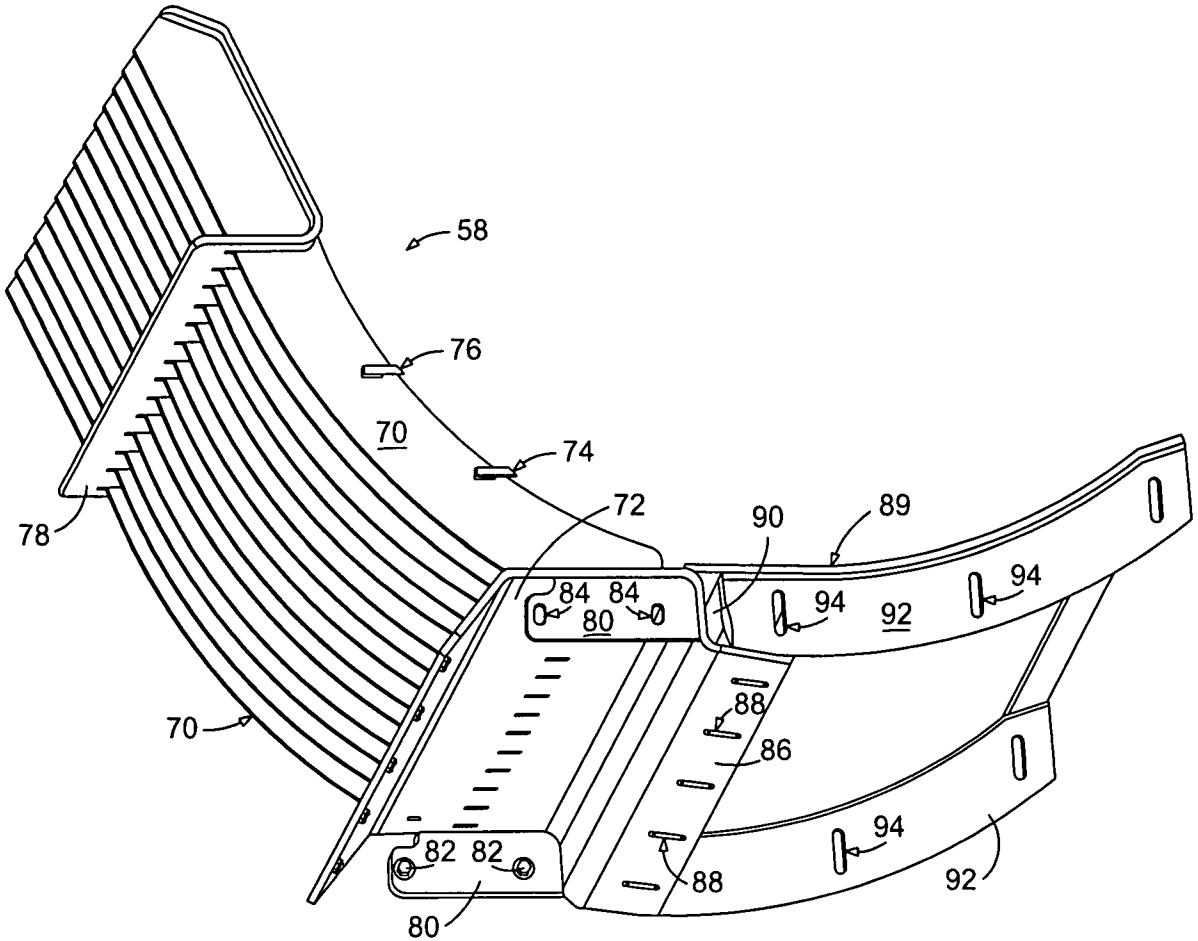
FIG. 6 is a lower perspective view of a second embodiment of a gauging assembly and an adjustable belly band that comprises a part of a preferred embodiment of the invention.
Figure 7:
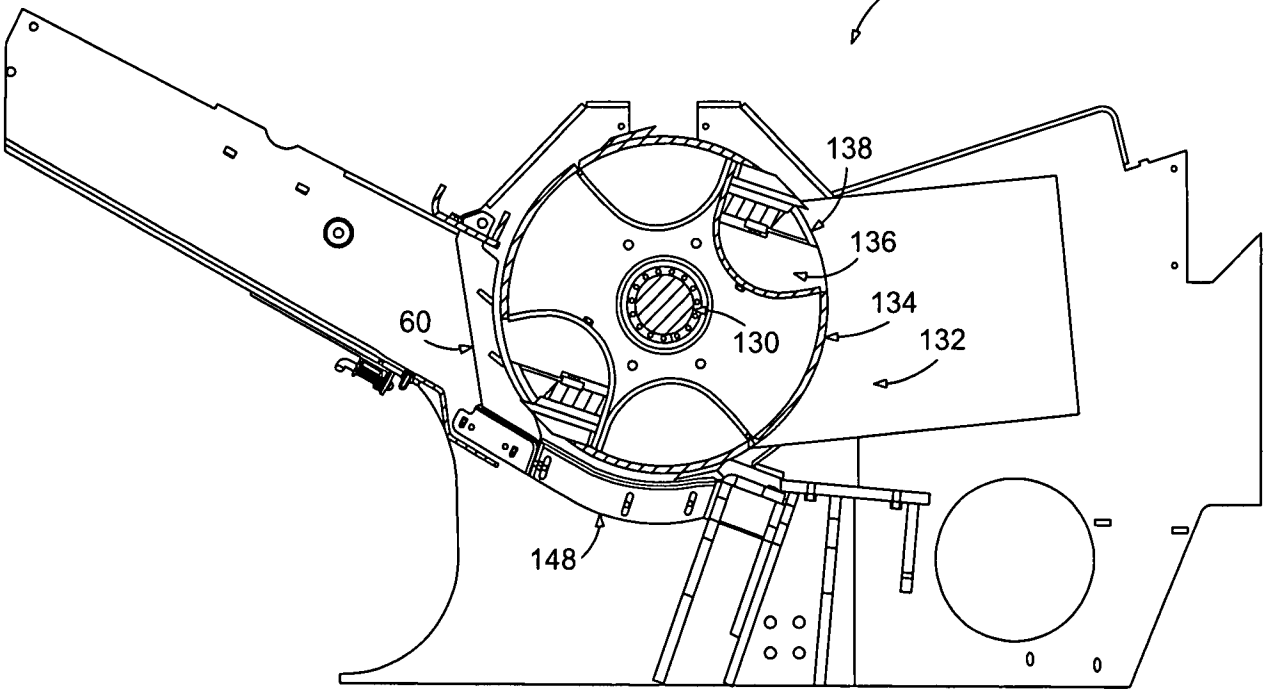
FIG. 7 is a schematic sectional view of a portion of an alternative embodiment of a material reduction machine showing a gauging assembly and adjustable belly band.

It is also preferred that a gauging assembly, such as first gauging assembly 56 (shown in FIGS. 2-5) or second gauging assembly 58 (shown in FIG. 6) or third gauging assembly 60 (shown in FIG. 7) be located in an intermediate housing that is downstream of and adjacent to the drum. Each gauging assembly comprises a plurality of flow diverters that are spaced across the width of the drum so as to provide a plurality of sized openings through which reduced material from the drum may pass. Thus, as shown in FIG. 5, gauging assembly 56 comprises a plurality of generally upright plates 62 that are mounted to base 64 and supported by spacing plates 66 and 68. Generally upright plates 46 are spaced apart across the width of intermediate housing 24 (and across the width of drum 32) between drum housing 22 and discharge chute 26 so as to provide, in cooperation with spacing plates 66 and 68, a plurality of sized openings through which reduced material such as wood chips cut by the drum may pass. Preferably, each of generally upright plates 62 has a front side that is curved to form an arc. Although FIG. 5 illustrates gauging assembly 56 as being comprised of plates 62, 66 and 68, it could alternatively be comprised of bars, rods or other shaped components. Furthermore, although FIG. 5 shows the gauging assembly as including ten generally upright plates and two spacing plates, different numbers of generally upright plates and spacing members may alternatively be provided. Thus, for example, as shown in FIG. 6, gauging assembly 58 includes fourteen generally upright plates 70 that are mounted to base plate 72 and supported by spacing plates 74, 76 and 78. Generally upright plates 70 are adapted to be spaced apart across the width of the intermediate housing (and across the width of the drum) between the drum housing and discharge chute so as to provide, in cooperation with spacing plates 74, 76 and 78, a plurality of sized openings through which reduced material such as wood chips cut by the drum may pass. Preferably; each of generally upright plates 70 has a front side that is curved to form an arc. Gauging assembly 60, shown in FIG. 7, is of a construction similar to that of gauging assemblies 56 and 58. The gauging assemblies may impede the progress of long or large chips in the discharge direction, allowing such chips to be carried around the drum housing by the rotation of the drum for further reduction.

Preferably, the gauging assembly is mounted with respect to the frame so as to be adjustable with respect thereto and/or with respect to the circumferential wall of the drum. It is also preferred that each of the plurality of interchangeable, belly bands is adapted to be adjustably attached to the frame. Referring again to FIG. 6, gauging assembly 58 includes a pair of side supports 80 that are welded or otherwise attached to base plate 72. Gauging assembly 58 is adapted to be attached to the frame of the material reduction machine by means of bolts (such as bolts 82) that are passed through generally vertically oriented slots 84 in side supports 80. Base plate 72 has a front end portion 86 that has a plurality of generally horizontally oriented slots 88 spaced across its width.

Located on the downstream end of belly band assembly 89 is rear support 90, the lower side of which is provided with a plurality of holes (not shown) that are spaced across the width of the belly band assembly and adapted to align with slots 88 so as to permit generally horizontal adjustment of the gauging assembly with respect to the belly band assembly. Belly band assembly 89 also includes a pair of side supports 92, and each of the side supports includes a plurality of parallel slots 94. Each parallel slot 94 is adapted to be aligned with a hole (not shown) in the frame, so that a bolt place through the hole in the frame and through the slot may be tightened in a plurality of positions along the slot. Thus, belly band assembly 89 is adapted to be attached to the frame so as to be vertically adjustable with respect thereto. Furthermore, the cooperation of slots 88 in front end portion 86 of base plate 72 and the adjacent aligned holes in the lower side of rear support 90 of the belly band, and the cooperation of slots 94 in side supports 92 of belly band assembly 92 and the adjacent aligned holes in the frame (not shown), and the cooperation of slots 84 in side supports 80 of gauging assembly 58 with adjacent aligned holes in the frame (not shown) will allow for adjustment of the gauging assembly with respect to the circumferential wall of the drum. Other arrangements of slots, holes and other features and mechanisms known to those having ordinary skill in the art to which the invention relates may be provided to allow for adjustment of the belly band with respect to the frame, and/or to allow for adjustment of the gauging assembly with respect to the frame, and/or to allow for adjustment of the gauging assembly with respect to the belly band and/or the circumferential wall of the drum.

FIG. 7 shows material reduction machine 110, which is similar to material reduction machine 10, but does not include an accelerator wheel. Mounted for rotation about shaft 130 of machine 110 is drum 132, which includes circumferential wall 134 and pockets 136. Knives 138 are mounted on the drum with respect to the circumferential wall so that as the drum rotates, the leading edges of the knives cut an arc that is concentric with and of a larger diameter than the circumferential wall of the drum. Machine 110 also includes a plurality of interchangeable belly bands, including belly band assembly 148, which is adjustable with respect to the frame in the same manner as belly band assembly 89 of FIG. 6. In addition, machine 110 includes gauging assembly 60, which is adjustable with respect to the frame and/or with respect to the circumferential wall of the drum.

Referring again to FIGS. 2-4, it can be seen that as drum 32 rotates so that leading edges 39 of knives 38 cut into the wood of feed stock 40, chips cut by each knife enter the pocket associated with the knife. The wood chips in each pocket remain in the pocket until the drum rotates to align, the pocket with intermediate housing 24, which includes gauging assembly 56. When drum 32 is rotated in the clockwise direction, as viewed in FIG. 2, leading edges 39 of knives 38 will first pass across top portion 96 of the wood of feed stock 40. As the knives continue to cut to the three o'clock position of the drum, the knives pass across the feed stock in a direction that is perpendicular to the direction of the grain. As the drum, continues to rotate so that the knives cut the feed stock nearer the six o'clock position of the drum, the knives pass across the feed stock in a path that is more parallel to the direction of the grain. Because the cutting path angle relative to the direction of the grain varies in this manner, the chips break from the feed stock differently, with the chips from the lower portion (as viewed in FIG. 2) tending to be longer and more irregular in size.

When it is desirable to produce chips of a more uniform size, the smooth-surfaced-belly band 48 shown in FIG. 2 may be replaced with bellyband 50 shown in FIGS. 3 and 4. When drum 32 is rotated in the clockwise direction, as viewed in FIGS. 3 and 4, leading edges 39 of knives 38 will first pass across top portion 96 of the wood of feed stock 40. The knives pass across the feed stock in a direction that is perpendicular to the direction of the grain, thus producing uniformly sized chips. As the knives continue to cut to the three o'clock position of the drum, the knives continue to produce uniformly sized chips that partially fill the associated pockets. As the drum continues to rotate so that the knives cut the feed stock nearer the six o'clock position of the drum, the knives pass across the feed stock in a path that is more parallel to the direction of the grain. Because the cutting path angle relative to the direction of the grain varies in this manner, the chips break from the feed stock differently, with the chips cut from the lower portion of the feed stock (as viewed in FIGS. 3 and 4) tending to be longer and more irregular in size. These chips are collected in the radially-outer part of the associated pocket. As the drum continues to rotate, the collected chips pass across the flow interrupters 52, where the irregularly sized chips in the pocket are repeatedly impacted by the flow interrupters and/or the knives and are further reduced. As the drum continues to rotate, the pocket will align with intermediate housing 24 which includes gauging assembly 56. The chips pass out of pocket 36 and pass through the gauging assembly into accelerator wheel housing 26. Accelerator wheel 42 is adapted to be rotated in a direction that is selected to increase the momentum of the chips passing through gauging assembly 56 and into discharge chute 28.

Although this description contains many specifics, these should not be construed as limiting the scope of the invention, but as merely providing illustrations of the presently preferred embodiment thereof, as well as the best mode contemplated by the inventors of carrying out the invention. The invention, as described herein, is susceptible to various modifications and adaptations, as would be understood by those having ordinary skill in the art to which the invention relates, and the same are intended to be comprehended within the meaning and range of equivalents of the appended claims.

What is claimed is:

1. A material reduction machine comprising:

(a) a frame;

(b) a drum housing mounted to the frame;

(c) a drum that is mounted for rotation within the drum housing, said drum comprising:

(i) a circumferential wall;

(ii) a knife having a leading edge, said knife being mounted on the drum with respect to the circumferential wall so that as the drum rotates, the leading edge of the knife cuts an arc that is concentric with and of a larger diameter than the circumferential wall of the drum;

(d) means for rotating the drum within the drum housing;

(e) a feed chute for directing material to be reduced into the drum housing;

(f) a discharge chute for directing reduced material away from the drum housing;

(g) a plurality of interchangeable belly bands, each of which is adapted, to be removably attached to the frame so as to form a portion of the drum housing and to provide an inner surface that forms a belly band arc portion that is concentric with and of a larger diameter than the circumferential wall of the drum, said belly band arc portion being adjacent to a portion of the arc cut by the leading edge of the knife, wherein the plurality of interchangeable belly bands comprises:

(i) a first interchangeable, belly band having a smooth inner surface;

(ii) a second interchangeable belly band having a plurality of flow interrupters spaced along its inner surface.

2. The material reduction machine of claim 1 wherein the circumferential wall of the drum is provided with a pocket, and the knife is mounted, on the pocket in such a way that as the drum rotates, the leading edge of the knife cuts an arc that is concentric with and of a larger diameter than the circumferential wall of the drum.

3. The material reduction machine of claim 1, wherein the drum comprises a plurality of pockets spaced around the circumferential wall of the drum with a knife mounted on each pocket in such a way that as the drum rotates, the leading edges of the knives cut an arc that is concentric with and of a larger diameter than the circumferential wall of the drum.

4. The material reduction machine of claim 1 wherein the plurality of flow interrupters define an arc that is concentric with and of a different diameter than the belly band arc portion.

5. The material reduction machine of claim 1 wherein each of the plurality of flow interrupters comprises a bar having a sharp leading edge that is mounted on the inner surface of the second interchangeable belly band.

6. The material reduction machine of claim 1 comprising:
(a) an accelerator wheel that is mounted for rotation in the same direction as the drum and is located downstream of the drum, said accelerator wheel being adapted to increase the momentum of the reduced material from the drum;
(b) means for rotating the accelerator wheel.

7. The material reduction machine of claim 1 which includes a gauging assembly that is located downstream of and adjacent to the drum, said gauging assembly comprising a plurality of flow diverters that are spaced across the width of the drum so as to provide a plurality of sized openings through which reduced material from the drum may pass.

8. The material reduction machine of claim 7 wherein the gauging assembly is mounted so as to be horizontally adjustable with respect to the frame.

9. The material reduction machine of claim 7 wherein at least a portion of the plurality of flow diverters has a front side that is curved to form an arc.

10. The material reduction machine of claim 9 wherein the gauging assembly is mounted so as to be adjustable with respect to the circumferential wall of the drum.

11. The material reduction machine of claim 1 wherein each of the plurality of interchangeable belly bands is adapted to be adjustably attached to the frame.

12. The material reduction machine of claim 11 wherein each of the plurality of interchangeable belly bands is adapted to be attached to the frame so as to be generally vertically adjustable with respect thereto.

13. The material reduction machine of claim 12 comprising a gauging assembly which includes a plurality of flow diverters that are spaced across the width of the drum so as to provide a plurality of sized openings through which reduced material from the drum may pass, said gauging assembly being adapted for generally horizontally adjustable attachment to each of the interchangeable belly bands.

14. The material reduction machine of claim 12 wherein:
(a) each of the interchangeable belly bands includes a pair of side supports;
(b) each of the side supports includes a plurality of parallel slots, each of which is adapted to be aligned with a hole in the frame, so that a bolt placed through the hole in the frame and through the slot may be tightened in a plurality of positions along the slot.

15. The material reduction machine of claim 14:
(a) wherein the downstream end of each of the interchangeable belly bands includes a rear support having a plurality of holes spaced across the width of the belly band;
(b) which includes a gauging assembly that is located downstream of and adjacent to the drum, said gauging assembly comprising:
(i) a base plate including a plurality of slots that are spaced across the width of the base plate, each of said slots being adapted to be aligned with a hole in the rear support of each of the interchangeable belly bands;
(ii) a plurality of flow diverters that are mounted on the base plate and spaced across the width thereof.

16. A material reduction machine comprising:
(a) a frame;
(b) a drum housing mounted to the frame;
(c) a drum that is mounted for rotation within the drum housing, said drum comprising:
(i) a circumferential wall;
(iii) a plurality of pockets spaced around and formed in the circumferential wall;
(ii) a plurality of knives, each of which has a leading edge and each of which is mounted on one of the pockets so that as the drum rotates, the leading edges of the plurality of knives cut an arc that is concentric with and of a larger diameter than the circumferential wall of the drum;
(d) means for rotating the drum within the drum housing;
(e) a feed chute for directing material to be reduced into the drum housing;
(f) an intermediate housing that is located downstream of and adjacent to the drum housing;
(g) a gauging assembly that is mounted in the intermediate housing adjacent to the drum, said gauging assembly comprising a plurality of flow diverters that are spaced across the width of the intermediate housing so as to provide a plurality of sized openings through which reduced material from the drum may pass;
(h) a discharge chute for directing reduced material away from the drum housing;
(i) a plurality of interchangeable belly bands, each of which is adapted to be removably attached to the frame so as to form a portion of the drum housing and to provide an inner surface that forms a belly band arc portion that is concentric with and of a larger diameter than the circumferential wall of the drum, said belly band arc portion being adjacent to a portion of the arc cut by the leading edges of the plurality of knives, wherein the plurality of interchangeable belly bands comprises:
(i) a first interchangeable belly band having a smooth inner surface;
(ii) a second interchangeable belly band having a plurality of flow interrupters spaced along its inner surface, said plurality of flow interrupters defining an arc that is concentric with and of a different diameter than the belly band arc portion.

17. The material reduction machine of claim 16 which includes:
(a) an accelerator wheel housing that is located downstream of and adjacent to the intermediate housing;
(b) an accelerator wheel that is mounted in the accelerator wheel housing and adapted to be rotated in the same direction as the drum to increase the momentum of the reduced material from the drum;
(c) means for rotating the accelerator wheel within the accelerator wheel housing.

18. The material reduction machine of claim 16 wherein each of the plurality of flow interrupters comprises a bar having a sharp leading edge that is mounted on the inner surface of the second interchangeable belly band.

19. The material reduction machine of claim 16 wherein the gauging assembly is mounted to the frame so as to be adjustable with respect thereto.

20. The material reduction machine of claim 16 wherein each of the plurality of interchangeable belly bands is adapted to be adjustably attached to the frame.

* * * * *